United States Patent [19]

Parsons et al.

[11] 3,932,018

[45] Jan. 13, 1976

[54] ELECTRICAL CONNECTIONS FOR CLOSELY SPACED CONDUCTORS AND APPARATUS FOR FORMING SUCH CONNECTIONS

[75] Inventors: Stuart L. Parsons, Belleair Beach; Henry George Wasserlein, Jr., Seminole, both of Fla.

[73] Assignee: AMP Incorporated, Harrisburg, Pa.

[22] Filed: Nov. 21, 1974.

[21] Appl. No.: 525,898

Related U.S. Application Data

[63] Continuation of Ser. No. 288,199, Sept. 11, 1972, abandoned.

[52] U.S. Cl. ..... 339/99 R

[51] Int. Cl.[2] ..... H01R 13/38

[58] Field of Search ..... 339/17, 95–99, 339/176, 270, 276; 174/84, 90

[56] References Cited

UNITED STATES PATENTS

| | | | |
|---|---|---|---|
| 3,156,514 | 11/1964 | Wing et al. | 339/97 P |
| 3,168,615 | 2/1965 | Owen et al. | 174/84 C |
| 3,201,744 | 8/1965 | Dean | 339/17 F |
| 3,259,873 | 7/1966 | Parkinson et al. | 339/97 P |
| 3,353,141 | 11/1967 | Budai | 339/99 R |
| 3,388,369 | 6/1968 | Zalmans | 339/95 R |
| 3,432,799 | 3/1969 | Richards et al. | 339/17 F |
| 3,504,101 | 3/1970 | Muto | 174/84 C |
| 3,596,236 | 7/1971 | Shlesinger, Jr. | 339/276 R |

*Primary Examiner*—Joseph H. McGlynn
*Attorney, Agent, or Firm*—F. W. Raring; R. W. Pitts; Jay L. Seitchik

[57] ABSTRACT

An electrical connection to an elongated conductor is made by means of a plate-like connecting member having a pair of open jaws which extend from a yoke. One of the jaws is connected to the yoke by a toggle link which is straightened when the jaws are closed to maintain the jaws in their closed condition and in electrical contact with the conductor. An apparatus is also disclosed for securing a plurality of connecting devices to a plurality of separate conductors in a single operation.

2 Claims, 14 Drawing Figures

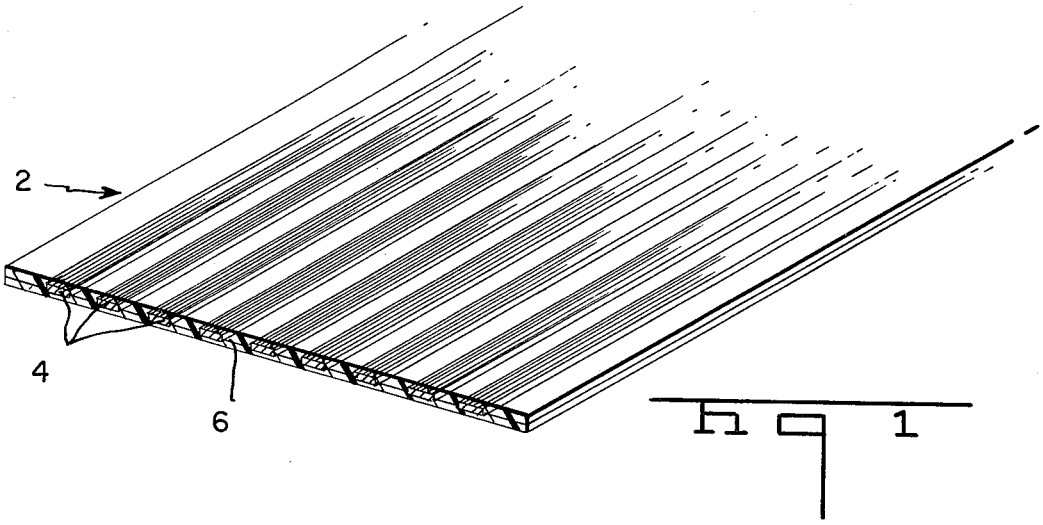
Fig 1
Fig 2
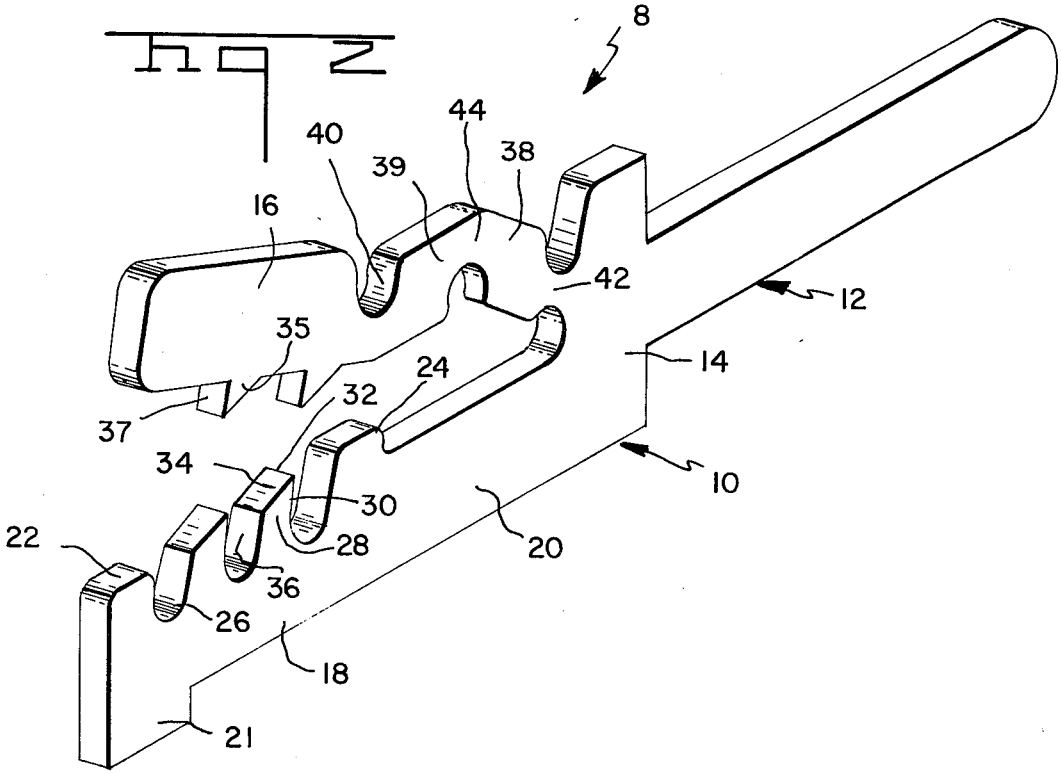

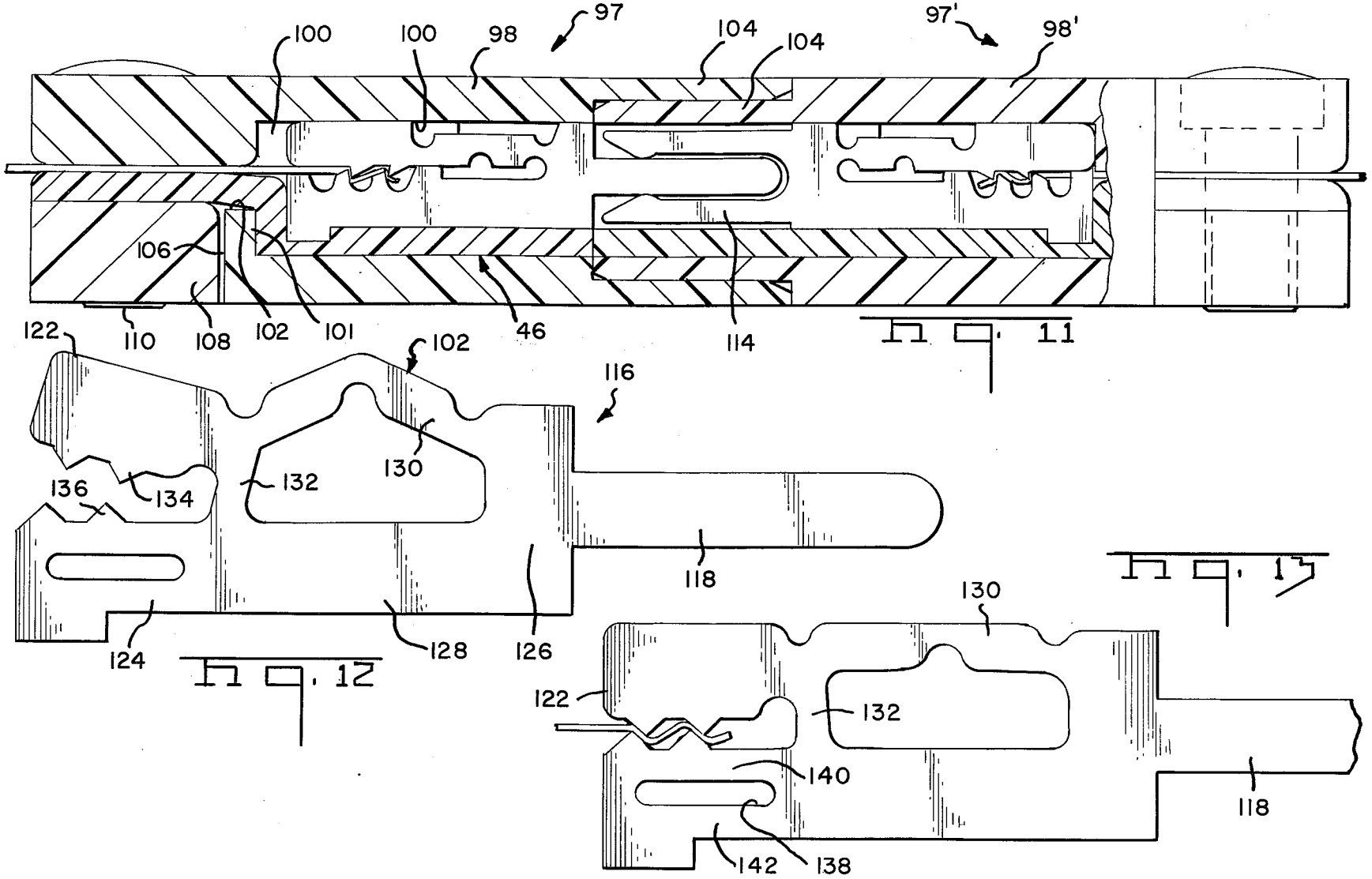
97'
98'
104
104
97
98
100
100
46
114
11
101
102
108
106
110
116
118
118
102
130
132
122
126
128
124
134
136
17
130
132
140
138
142
122

ELECTRICAL CONNECTIONS FOR CLOSELY SPACED CONDUCTORS AND APPARATUS FOR FORMING SUCH CONNECTIONS

This is a continuation of application Ser. No. 288,199, filed Sept. 11, 1972, and now abandoned.

BACKGROUND OF THE INVENTION

The U.S. Pats. to Parkinson et al. No. 2.259,873 and Dean No. 3,201,744 discloses extremely thin plate-like electrical connecting devices having a pair of open jaws with opposed teeth. These connecting devices are applied to conductors by simply bending the jaws in their own planes relatively towards each other and in doing so plastically deforming the metal at the inner ends of the jaws so that they will remain in closed condition and in engagement with the conductor positioned between the jaws. These extremely thin plate-like connecting devices as disclosed in Dean and Parkinson et al are particularly adapted to be used on multi-conductor cables of the type having parallel spaced-apart conductors (either flat ribbon conductors or round wire conductors) contained within a flat sheet of insulating material.

The instant invention is directed to the achievement of improved flat plate-like connecting devices of the general type disclosed in the above-identified U.S. patents but having improved means for penetrating the insulation of the conductors and particularly for maintaining the closed jaws of the connecting devices in intimate contact with the conductors of the cable. The invention is further directed to the provision of improved multi-contact electrical connectors for flat multi-conductor cables and to apparatus for simultaneously applying a plurality of connecting devices to the individual conductors of a cable.

It is an object of the invention to provide an improved connecting device for establishing an electrical connection with an elongated conductor, particularly a conductor in a flat cable such as a ribbon conductor or a round wire conductor in a flat cable. A further object is to provide a connecting device having closeable jaws for establishing electrical contact with a conductor and having improved means for maintaining a reliable electrical contact between the jaws and the conductor. A still further object is to provide a connecting device having closeable jaws and incorporating improved means for establishing electrical contact with the conductor during closure of the jaws. A still further object is to provide an improved multi-contact electrical connector for flat conductor cables having a plurality of parallel conductors arranged in a single plane. A still further object is to provide an improved apparatus for applying connecting devices to the conductors of a flat conductor cable.

These and other objects of the invention are achieved in a preferred embodiment thereof which is briefly described in the foregoing abstract, which is described in detail below, and which is shown in the accompanying drawing in which:

FIG. 1 is a perspective view of a common form of flat conductor cable.

FIG. 2 is a perspective view of a contact terminal pin having a connecting means in accordance with the invention.

FIG. 11 is a sectional sideview of a connector assembly comprising one connector part having contact pins therein and another connector part having a contact socket therein.

FIG. 12 is a sideview of an alternative form of terminal pin in accordance with the invention.

FIG. 13 is a view similar to FIG. 12 for showing the terminal pin of FIG. 12 applied to a conductor.

Figure 3:
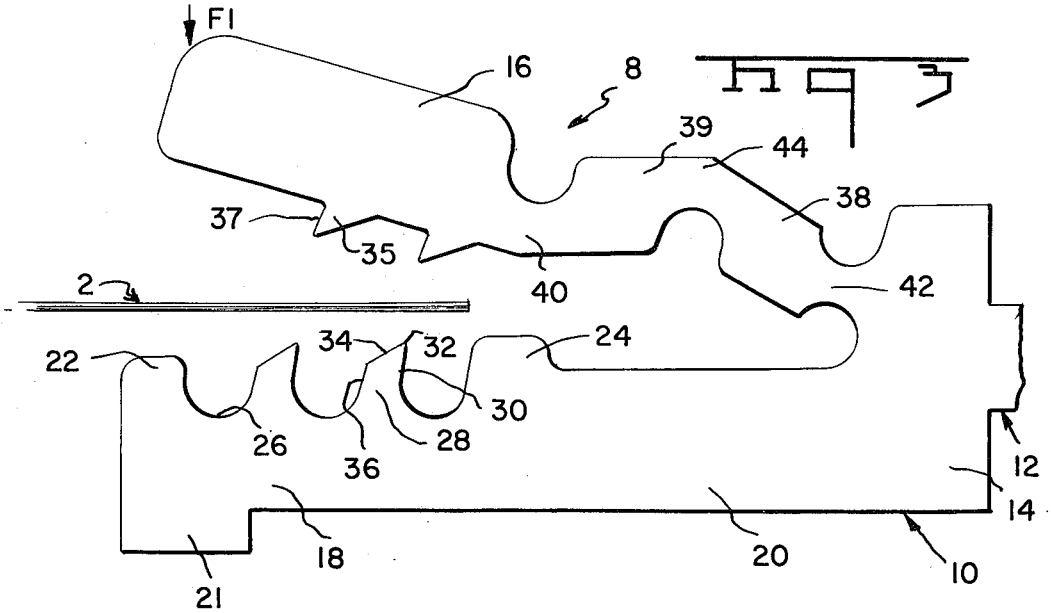
FIG. 3 is a sideview of the contact terminal of FIG. 2 prior to application to a conductor and showing a conductor positioned between the jaws of the connecting means.

A typical flat conductor cable as shown at 2 in FIG. 1 comprises a plurality of relatively thin ribbon-like conductors 4 which are contained within an insulating film 6. Flat cables as shown in FIG. 1 are being used on an increasing extent in the electrical and electronics industries and there is an increasing tendency to use cables having relatively small conductors on closely spaced centers. For example, cables having conductors located on centers which are 0.050 inches apart are now commonly used. When terminating such cables, it is desirable to avoid, if possible, spreading the conductors at the points of termination in order to take full advantage of the compactness of flat conductor cables. It follows that an extremely thin terminal is required or at least desirable for flat cables.

FIG. 2 shows a contact terminal in accordance with the invention having a connecting means 10 at one end thereof in accordance with the invention and having a flat contact terminal pin 12 at its other end. The contact means has a yoke portion 14 which extends for the entire width of the terminal and a pair of open jaws 16, 18 which are spaced from, and connected to, the yoke portion. The lower jaw has an upwardly extending stop 22 at its free end (its lefthand end as viewed in the drawings) and has three generally semi-circular recess 26 at spaced-apart locations on its inner edge. These recesses define two upwardly projecting teeth 28 which have rightwardly facing edges 30 which serve as contact surfaces when the connecting device is applied to a conductor. Each tooth is pointed as shown at 32 and has a downwardly sloping crown 34 on the opposite side thereof from the contact surface 30 which extends to the adjacent recess 36. The inner end of the jaw 18 is provided with a stop 24 which functions to limit downward movement of the upper jaws during application to a conductor as will be described below. The lower jaw 18 is connected to the yoke portion 10 by means of a relatively wide shank or arm 20 which is resistant to bending so that this lower jaw is relatively stiff and is not deformed while the upper jaw is being moved downwardly into engagement with the conductor.

Upper jaw 16 extends divergently with respect to the lower jaw 18 from the yoke 14 and has two teeth 35 extending downwardly on its lower edge. These teeth have forwardly facing contact surfaces 37 which cooperate with the contact surfaces 30 to establish electrical contact with the conductor. The upper jaw 16 is connected to the yoke 20 by an arm which is in the form of two toggle links 38, 39 the link 39 being integral with the jaw 16 by means of a toggle "joint" 40 and the link 38 being integral with the yoke 14 by means of a fixed toggle joint 42, the two links being connected to each other by a knee joint 44. The toggle joints 40, 42, 44 are delineated by the punched out areas of each end of each of the toggle links 38, 39. The toggle joints are thus relatively narrow sections of sheet metal which connect the toggle links to each other and to the yoke and to the upper jaw. These narrow sections serve as the pivot joints of a conventional toggle mechanism by virtue of the fact that the metal in these narrow sections yields and is plastically deformed to a high degree when the toggle is straightened so that the toggle links pivot with respect to the joints until they are in alignment with each other.

Figure 4:
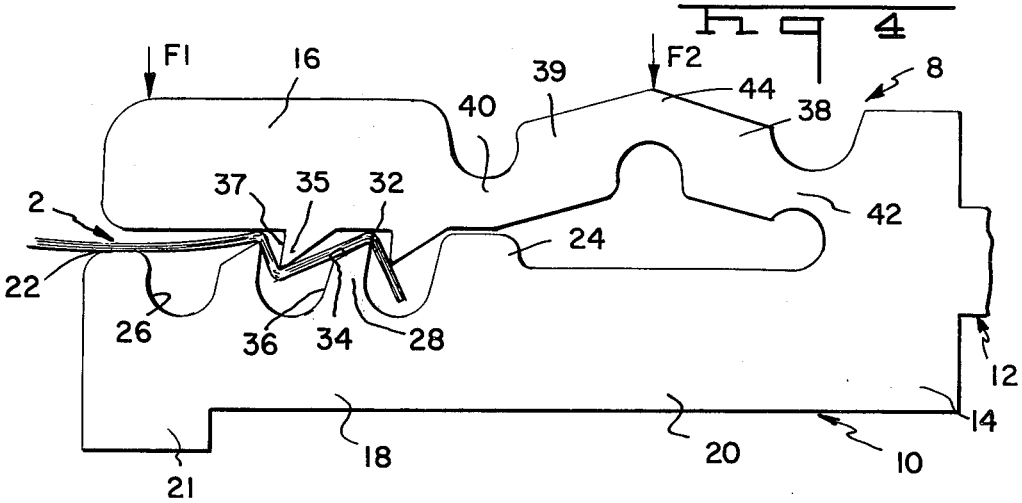
FIGS. 4 and 5 are views similar to FIG. 3 illustrating the application of the connecting means to the conductor.
Figure 5:
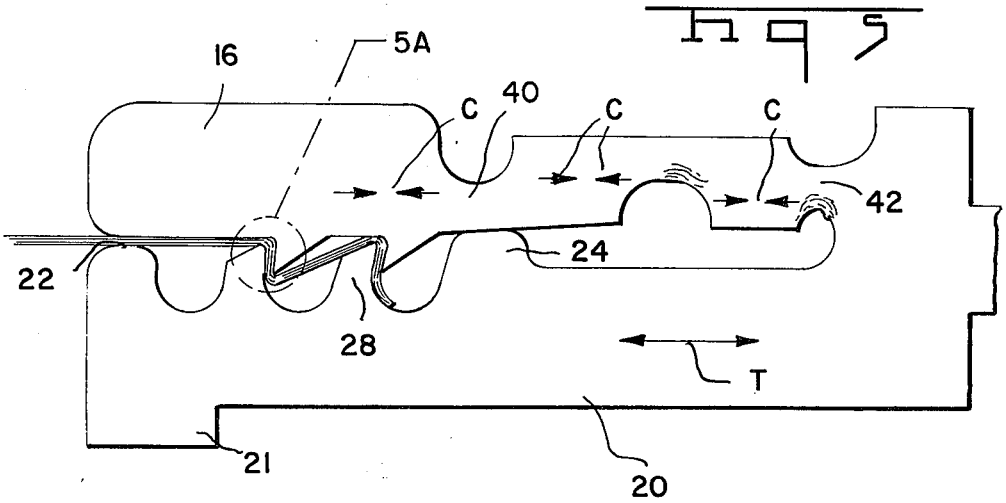

While it is preferred to apply a plurality of connecting devices to the conductors of a flat cable in a single operation as will be described below, the mechanism of application and the manner in which electrical contact is established with the conductor can be best understood from a consideration of the application of a single connecting device to a single conductor as illustrated in FIGS. 3–5. It will be understood that during application, the connecting means is supported on each of its sides and along lower edge of the lower jaw 18 so that forces can be applied as illustrated in the drawing to bring about deformation of the toggle joints in the plane of the connecting means.

Referring first to FIG. 3, the conductor is positioned between the open jaws with the end portion thereof extending past the inner one of the teeth 28. A downward force $F_1$ is then applied to the upwardly facing edge of the movable jaw 16 adjacent to its free end. This force will have the effect of bending the upper jaw 16 and the toggle links 38, 39, as a unit downwardly with concomitant yielding and plastic (i. e. permanent) deformation of the fixed toggle joint 12. The sheet metal material in this fixed toggle joint 42 will yield and permanently deform during this initial bending step (rather than the material in either of the toggle joints 40, 44) for the reason that the joint 42 is an area of comparative weakness which is furthest removed (relative to the toggle joints 40, 44) from the point of application of the force, that is from the end of the jaw 16. This bending operation will, give rise to outer fibre stresses in the toggle joint 42 which will be compressive stresses on the lower side of the toggle joint as viewed in the drawing and tension stresses on the upper side thereof.

After downward bending of the upper jaw and the toggle links as a unit has been completed, the lefthand end of the jaw 16 will be spaced inwardly from the left end of the fixed jaw 18 and the teeth 35 will project downwardly into the recesses 26 but the surfaces 37 of the teeth 35 will be substantially spaced from the contact surfaces 30 of the teeth 28 on the lower jaw. Additionally, the stop 24 will have prevented downward movement of the upper jaw and toggle as a unit beyond the position shown in FIG. 4.

The force $F_1$ is maintained on the end of jaw 16*a* downward force $F_2$ is applied to the upper edge of the knee joint 44 of the toggle. Force $F_2$ causes the metal in this knee joint to yield and be plastically deformed in its own plane until the two toggle links 39, 38 are in substantial alignment with each other. The application of this downward force $F_2$ produces tension stresses on the lower portion of the knee joint and compressive stresses above the neutral axis of this area. At the same time, the material in the fixed toggle joint 42 is stretched adjacent to the lower edge of this joint and is compressed adjacent to the upper edge. The movable joint 40 of the toggle mechanism is also plastically deformed during application of the force $F_2$. It will be explained below, the extreme cold working of the metal of the connecting device in the toggle joints 40, 44, 42 assists in preserving the stability of the finished electrical connection.

The manner of establishing electrical contact with the conductor can be understood best from FIGS. 4 and 5. As shown in FIG. 4, after the upper jaw 16 and the toggle link have been bent downwardly the teeth 35 of the upper jaw will project into the recesses 26 of the lower jaw and will be spaced from the teeth 28 of the lower jaw. The conductor will be pushed downwardly by the points of the teeth so that it will have portions extending between the points of the teeth of the lower jaw and the points of the teeth of the upper jaw. When the toggle is subsequently straightened by application of the force $F_2$ to the knee joint of the toggle while the force $F_1$ is maintained as a static force on the free end of the upper jaw, the upper jaw moves leftwardly of will be apparent from a comparison of the position on the end of the upper jaw in FIGS. 4 and 5. The teeth 35 of the upper jaw are thus moved leftwardly and towards the teeth of the lower jaw until they have pinched portions of the conductor between the contact surfaces 37, 30. Advantageously, the teeth of the lower jaw are designed such that they will be slightly flexed or stressed in the manner of an end loaded cantilever beam by the forces applied by the teeth of the upper jaw 16 so that the conductor is pinched very tightly between the surfaces 30, 37. This pinching of the conductor between the surfaces causes exposure of the metallic ribbon conductor with resulting electrical contact. Examination of a portion of a conductor removed from between the jaws of a connector indicates that the plastic insulation is extruded from between the opposed surfaces 37, 30 under the influence of the extremely high unit pressures developed during straightening of the toggle. It also appears from examination of some specimens that the plastic insulation may fracture after some extrusion has taken place to expose the ribbon conductor. The actual mechanism may thus depend upon the precise nature of the plastic insulation, whether it is highly plasticized and therefore extremely flowable or, on the other hand, whether it is not highly plasticized and tends to rupture or fracture.

Connecting devices in accordance with the invention can be manufactured by stamping any suitable conductive material, for example, a suitable phosphor bronze (normally 4% Sn, 0.05% P, 99.5% CU + Sn + P) or a cartridge brass (70% Cu, 30% Zn). When either of these alloys are used, they are advantageously in a full hardened condition and it has been found that the toggle joints will, notwithstanding the fully hardened conditions of the material, yield when the bending operations described above are carried out. It is necessary to dimension the toggle joints 40, 44, 42 such that the metal in these joints will yield in the manner described above; that is, the fixed toggle joint 42 must yield rather than the joints 40, 44 when the initial closing force $F_1$ is applied and this result can be brought about by proper selection of the width of the fixed toggle joint 42.

Connecting devices in accordance with the invention can be made in a wide range of sizes and it is a particular advantage that the principles of the invention are applicable to small size connectors, for example, those intended for use on flat conductor cables having a width of about 0.025 inches. A particular embodiment of the invention produced for use on such flat conductors is stamped from metal stock having a thickness of 0.016 inches. Connecting devices of this invention can be mounted in a housing described below and applied directly to the conductors of the cable.

A salient advantage of a connecting device in accordance with the invention is that after application to the conductor, there is virtually no relaxation as a result of springback of the deformed connecting means. The term "springback" as used in the electrical terminal art is generally understood to refer to the residual elasticity which remains in a metal part, after it has been stressed beyond its elastic limit. Conventional crimping operations depend upon deforming a metal ferrule or the like beyond its elastic limit until it is in intimate contact with the conductor in which it is being crimped. Springback is thus a highly deleterious effect in crimping operations for the reason that it tends to reduce the contact pressure between a connecting means of a terminal and a conductor after the terminal connecting means has been cold forged or otherwise crimped onto the wire.

The undesirable effects of springback are eliminated in accordance with the practice of the instant invention by reason of the fact that if the applied connector, the constant surfaces 37, 30 of the jaw teeth are maintained in engagement with each other by a closed loop spring system which is illustrated in FIG. 5. In FIG. 5 the arrows C denote internal compressive stresses while the arrows T denote tension stresses. As indicated in the diagram, the aligned toggle links 38, 39, function as compressed springs which urge the contact surfaces of the teeth of the upper jaw against the contact surfaces of the teeth of the lower jaw, the portions of the upper jaw between the teeth and the toggle links also being under compression as indicated. The yoke portion serves as a relatively massive support for the jaws and is not significantly stressed because of its substantial mass. The lower jaw and the shank portion are stressed in tension by virtue of the leftwardly directed forces applied to the contact portions of the teeth of the lower jaw. Finally, the lower teeth may be flexed or stressed in the manner of a cantilever beam by virtue of the forces applied to their surfaces 30 by their upper teeth 35. The conductor is thus gripped or tightly held in a self-contained closed circuit spring system which is incapable of relaxing its contact force on the conductor. It should be mentioned that the toggle mechanism or linkage can be straightened to the point that it is slightly over center rather than on center to further insure against any relaxation.

Failure or partial failure in cold-formed electrical connections is frequently a result of dimensional instability as caused, for example, by relaxation, springback, creep, and thermal expansion and contraction. Such failures are avoided in the practice of the invention because of the fact that stored energy is provided in a manner such that any dimensional instability is compensated for as it occurs. The manner of stressing the connecting device as a whole, for example, is such that it will compensate for any creep in the conductor which may take place and it will follow any thermal expansion and contraction in both directions so that temperature cycling will not result in any permanent change. The cantilever stressing mode of the lower teeth provides a further source of stored energy for the maintenance of contact stability which is substantially independent of the closed loop toggle system and thereby further enhances the reliability of the connection.

FIG. 11 shows a multi-contact electrical connector assembly comprising two connector parts 97, 97' each of which contains a plurality of electrical contact terminals in accordance with the invention secured to the conductors of a flat conductor cable. Since the connector parts 97, 97' are similar to each other in most respects, a description of one will suffice for both and the connector part 97 containing the electrical contact pins will therefore be described in detail.

The connector part 97 comprises a rack or frame 46 which is contained in a housing generally indicated at 98. The rack or frame (FIGS. 6 and 7) is in the form of a molded block of suitable insulating material such as nylon having a base 48 and a side wall 50 extending from one side edge of the base. A lip 51 extends outwardly from the upper end of sidewall 50 for cable clamping purposes as will be described below. A plurality of barriers 54 extend upwardly from the upper surface of the base 48 and define individual cavities 52 in which individual contact terminal pins are mounted. Relatively thick end walls 66 extend from the ends of the base and have recesses 68, 70 therein for reasons which will be apparent from the description which follows.

Figure 6:
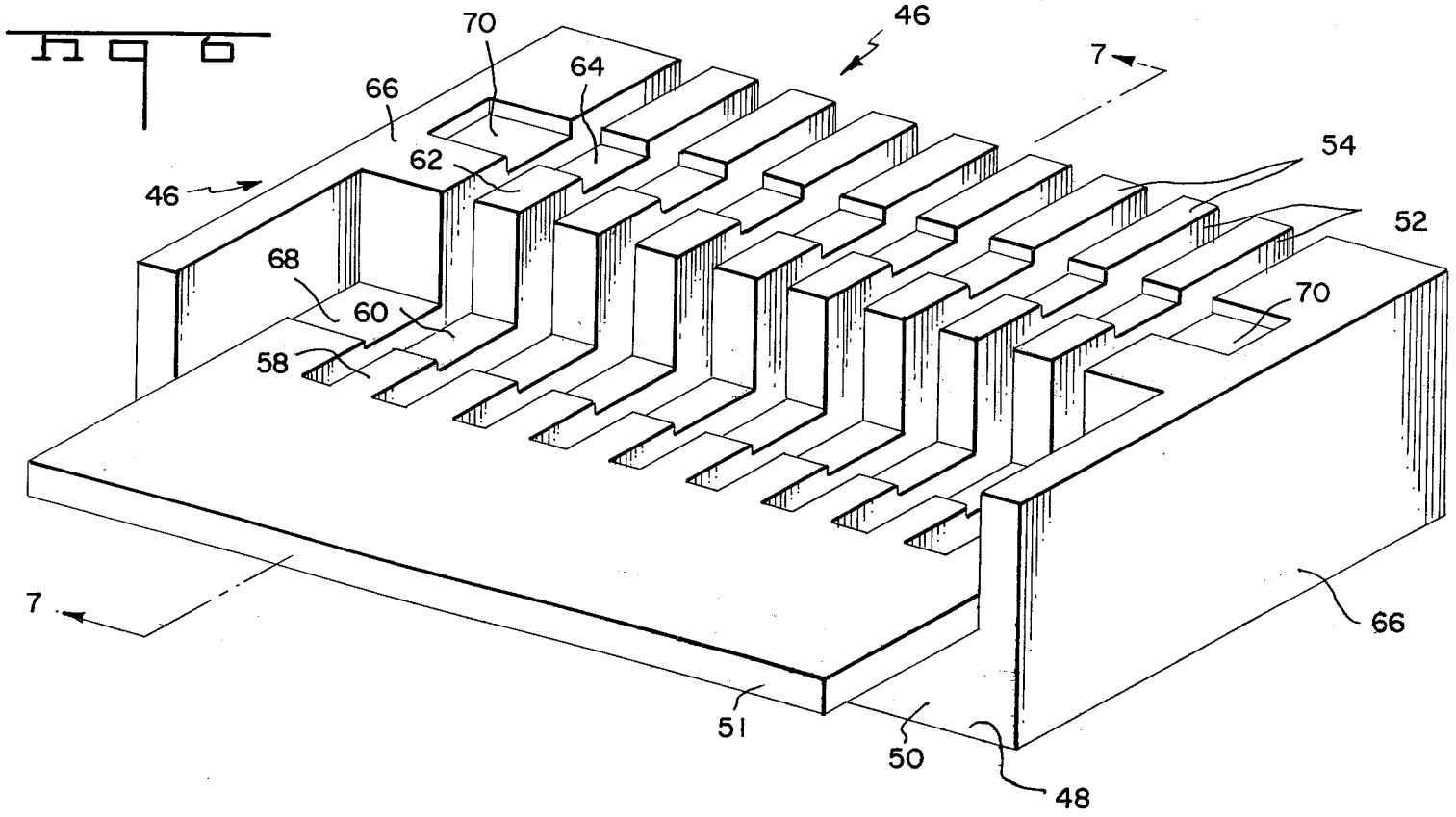
FIG. 6 is a perspective view of a frame member which is adapted to hold a plurality of terminal pins of the type shown in FIG. 2, this frame member being a part of a connector assembly as shown in FIG. 11.

The barriers have upper edges which are contoured as shown in FIG. 6 and which are on the same level as the upper end of the sidewall 50 and 58, adjacent to the sidewall. An intermediate recess 60 is provided in spaced relationship to the side wall and the righthand portion of each barrier is elevated above the sidewall 50 as shown at 62, a shallow recess 64 being provided intermediate the ends of this righthand portion of the barrier. Additionally, a shallow recess 56 is provided in the base in each cavity adjacent to the wall 50 for reception of a depending ear 21 of the contact terminal for locating purposes. The relatively thick endwalls 66 are provided with recesses 68, 70, the inner ends of these recesses being co-planar with the edges 60, 64 respectively of the barriers.

Figure 7:
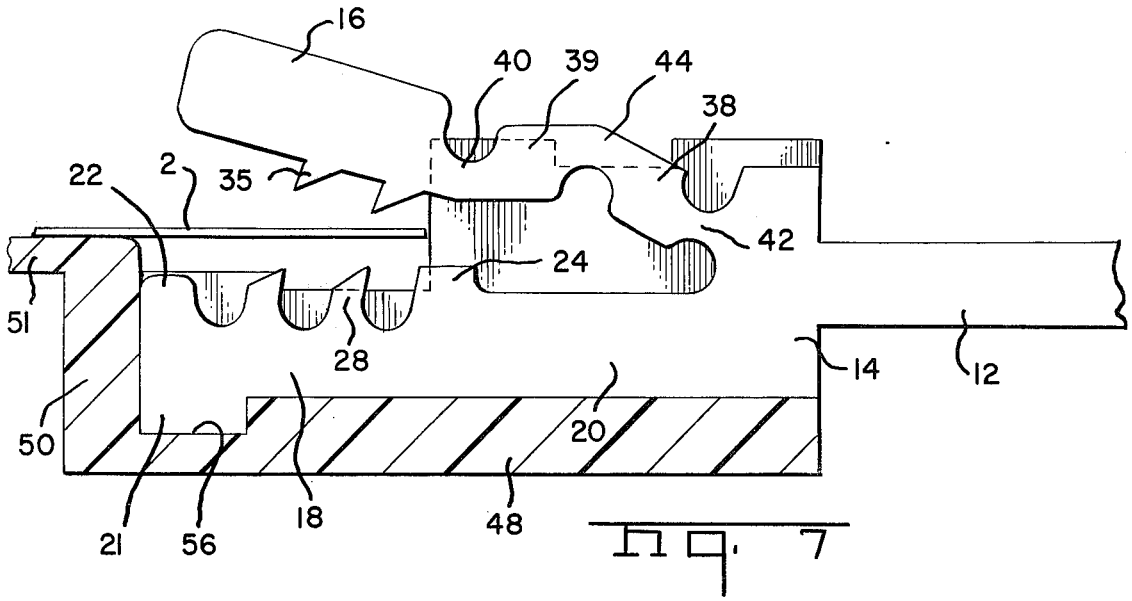
FIG. 7 is a sectional view taken along the lines 7—7 of FIG. 6.
Figure 5A:
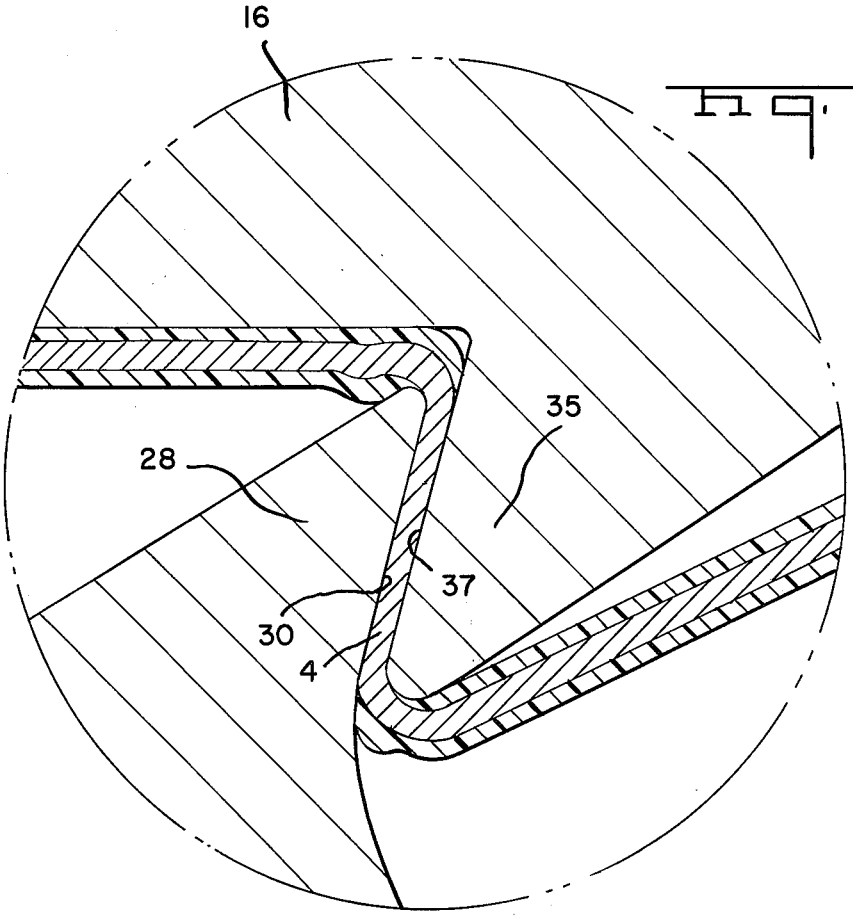
FIG. 5A is a sectional view on an enlarged scale of the zone indicated in FIG. 5.

As is apparent from FIGS. 6 and 7, when the contact terminals are located in the cavities 52, the free ends of the jaw 16 will project above the edges 50 of the adjacent barrier walls and the knee joints 44 of the toggles will project above the recesses 64 of the elevated portions of the barrier walls.

Figure 8:
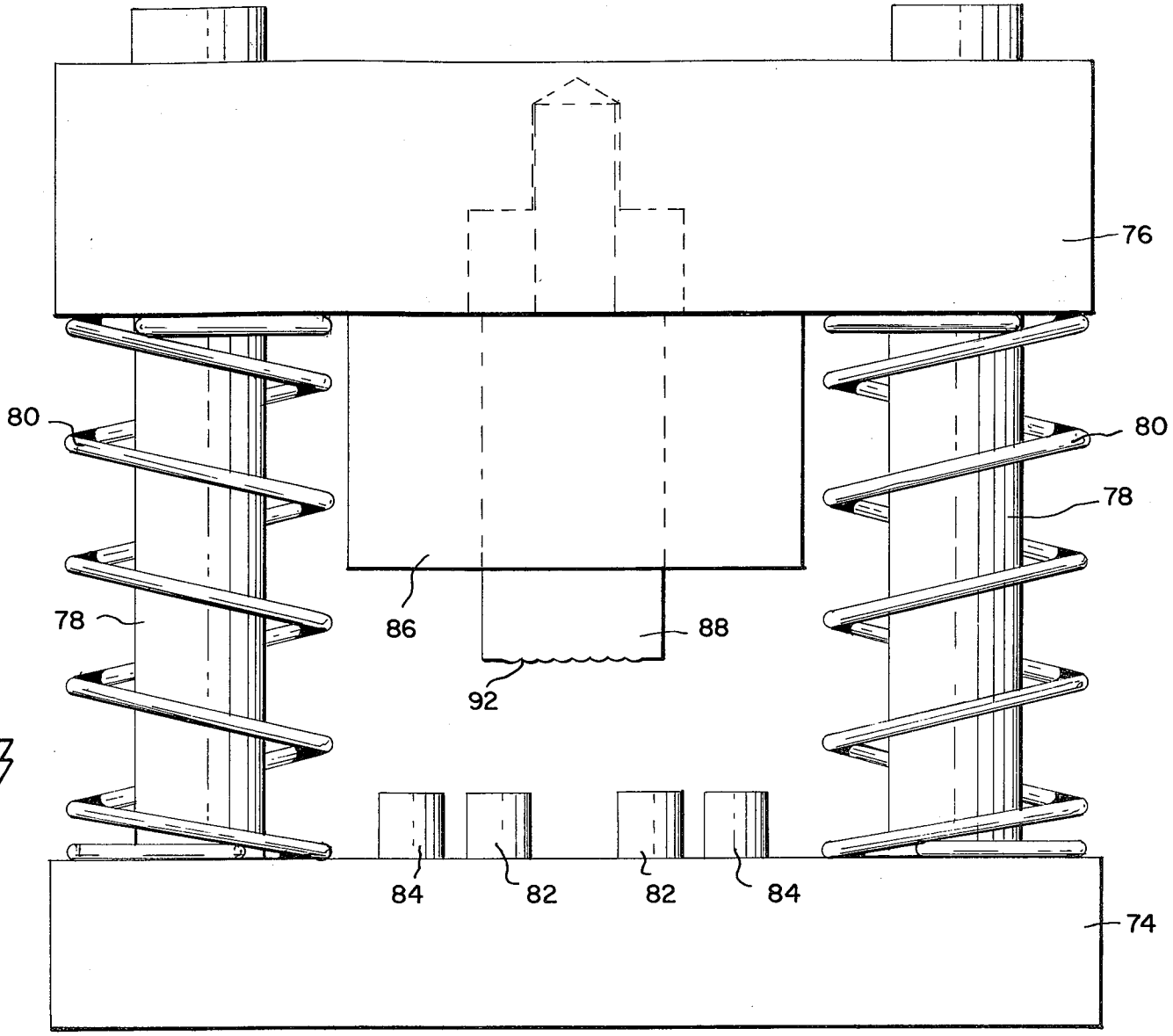
FIG. 8 is a front view of the applicator adapted to simultaneously apply a plurality of terminal pins of the type shown in FIG. 2 to each of the conductors of a flat cable.
Figure 9:
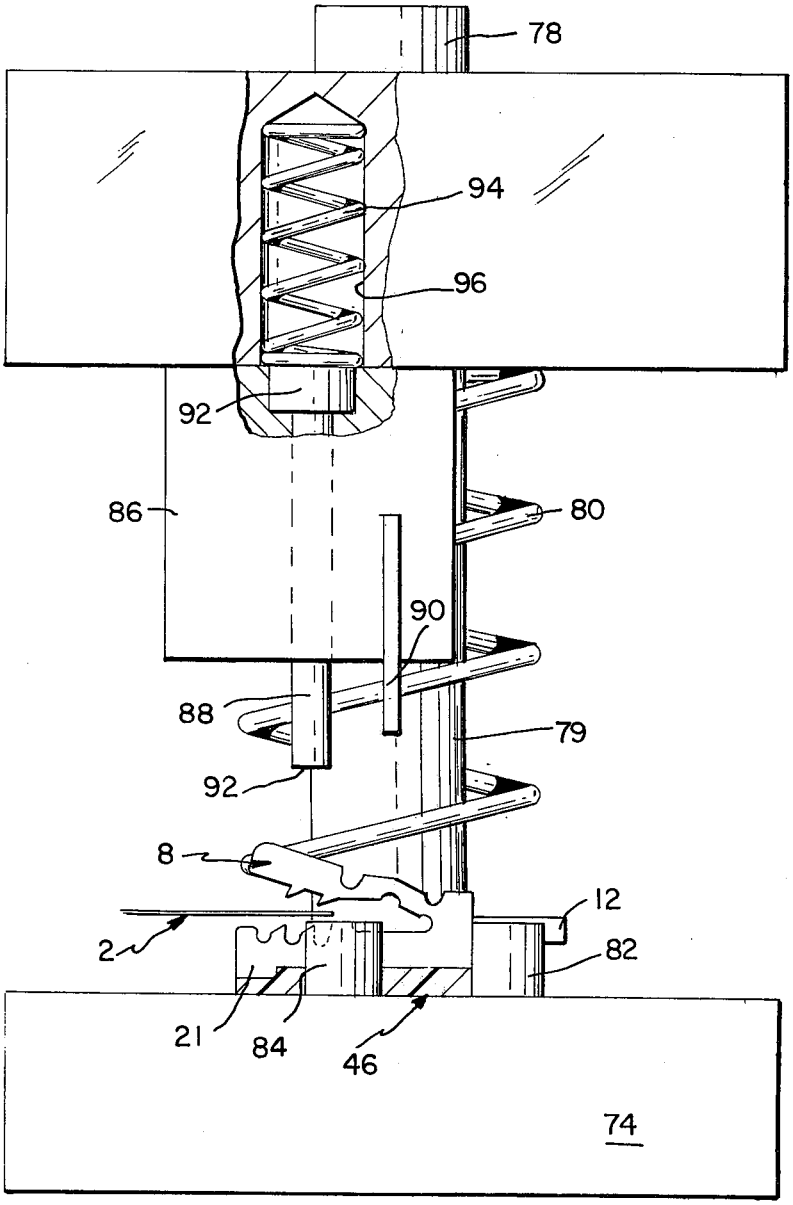
FIG. 9 is a sideview of the applicator of FIG. 8.
Figure 10:
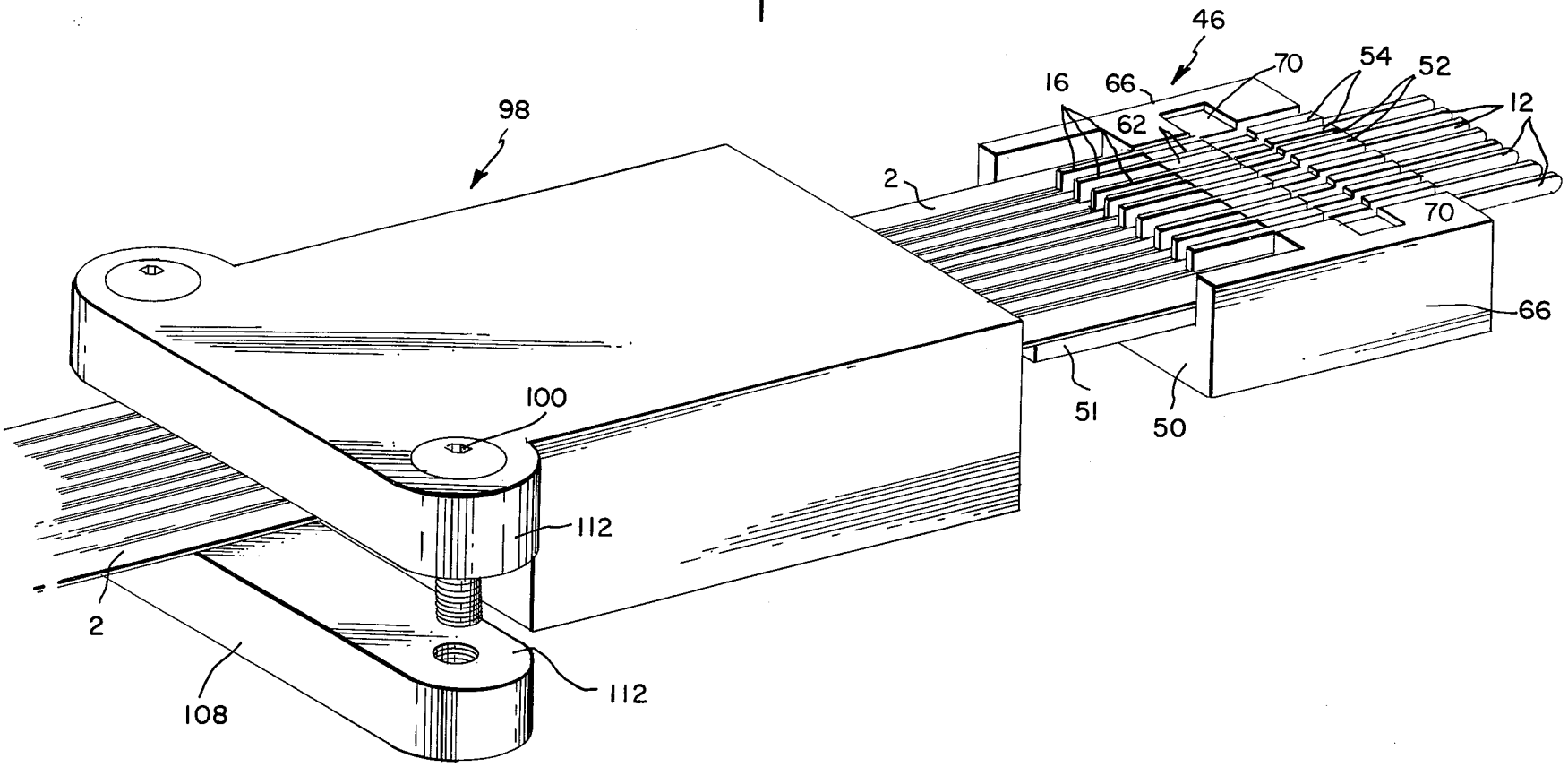
FIG. 10 is a perspective view of a multi-contact connector in accordance with the invention, the housing of the connector being exploded from the end of the cable and from the rack or frame which contains the terminal pins.

A frame or rack 46 which has been pre-loaded with electrical contact terminals is applied to the conductors of a flat conductor cable by means of an apparatus such as that shown in FIGS. 8 and 9 and similar to a conventional die shoe or die set in which punches and dies are mounted. This applicator thus comprises a lower shoe or block 74 and an upper block 76. A pair of guide pins 78 extend from the lower block and through openings in the upper block, springs 80 being interposed between the surfaces of the blocks and in surrounding relationship to these pins to bias the upper shoe to the position shown. Four locating pins 82, 84 are mounted on the upper surface of the lower block 74 to precisely locate the rack or frame with reference to the application tooling punches 88, 90 described below.

A tool holder block 86 is secured by suitable fasteners to the underside of the upper block 76 centrally between the guide pins 78. A bending punch 88 in the form of a generally rectangular plate is mounted in the tool holder block and located such that when the upper shoe or block is moved downwardly, the lower edge of this bending plate or tool will engage the free ends of the jaws 16 of the terminals mounted in the frame supported on the lower block. Advantageously, this punch is provided with spaced apart recesses 92 shaped to engage and center the free ends of the jaws 16 of the terminals when the upper block is moved downwardly.

The punch 88 is slidably mounted on a recess in the tool holder block 86 and has an enlarged upper end 92 which is slidably supported in an enlarged upper end of the recess in the tool holder block. Spring means 94 are provided in a recess 96 in the head block 76 and bear against the enlarged head 92 of the bending tool to permit overtravel in a downward direction of the tool holder block during operation.

A plate-like toggle straightening punch 90 is mounted in the tool holder block 86 behind the bending tool 88 and has a downwardly facing edge 91 which is normally spaced from and above the lower edge 92 of the bending tool 88. This toggle straightening tool 90 is rigidly mounted in the tool holder block as shown.

In order to apply a plurality of terminals mounted in a rack to the conductors in a cable, the rack is located on the surface of the lower block 94 by means of the four locating pins 82, 84. The cable is then positioned between the open jaws of the contact terminals in the rack with its individual conductors in alignment with the individual terminals in the rack. The upper block 76 is then moved downwardly by any suitable force applying means, for example, a conventional arbor press. During such downward movement of the upper shoe 76, the bending punch 88 first engages the free ends of the jaws 16 and bends the jaws and the toggle links of the individual contact terminals downwardly as previously described with reference to FIG. 4. Therefore, the bending punch remains stationary and the upper shoe 76 and tool holder block 86 move downwardly with concomitant compression of the spring 94. The lower edge 91 of the toggle straightening punch 90 then engages the knee joints of the toggle links and straightens these links as previously described with reference to FIG. 5.

The force required to apply a multiplicity of connecting devices to an equal number of conductors as explained above, is quite low as compared with other methods of applying connecting devices to conductors. The toggle is widely recognized as an extremely effective force multiplier in hand tools and in machines and is widely used when it is desired to develop a high unit force in a hand tool, for example, from a relatively low available force. The force multiplying advantages of the toggle in the practice of the present invention thus permit the simultaneous application of a large number of connecting devices to conductors without the requirement of an unduly high actuating force.

It is also advantageous that in accordance with the invention, the crimping force as applied by the apparatus of FIGS. 8 and 9 is applied in a direction normal to the plane of the conductor cable and the crimping apparatus, whether it be of the type shown in the drawing or of another type, need not completely surround the connector containing the connecting devices. These features render practical the pre-loading of the connector housing with connecting devices and the simultaneous application of all of the connecting devices to the cable.

The previously identified housing 98 is advantageously a molded block of insulating material such as nylon having a trough-like recess 100 extending into one side thereof for reception of the frame 46. The inner wall 101 of this recess is provided with an elongated opening 102 for reception of the flat conductor cable and the lip 51 of the frame. It will be understood that the cable is inserted through this recess prior to application of the terminals in the rack to the cable conductors as described immediately above. The housing is then slid along the cable until the rack and the terminals are received in the trough-like recess 100.

The housing advantageously has a hood portion 104 which projects forwardly beyond the yoke portion of the terminals mounted in the rack to protect the projecting ends of the terminals. Additionally, the housing is recessed on its rearwardly facing side as shown at 106 and a clamping bar 108 is located in this recess and secured by means of fasteners 110 to the housing, ears 112 being provided on this clamping bar and on the housing for the accommodation of the fasteners. The clamping bar is tightened against the surface of the housing thereby tightly gripping the cable and providing a strain relief so that if the cable is pulled relative to the housing, the electrical connection between the conductors of the cable and the contact terminals in the rack will not be disturbed.

The connector part 97' differs from the connector part 97 in that it contains contact receptacles each of which has a pair of spaced apart tines 114 which are adapted to receive the contact pins of the terminals in the connector part 97. The connecting portions of the terminals in the connecting part 97' are otherwise identical to the corresponding connecting portions of the terminals in the connector part 97. It will be noted that the projecting hood 104' of the connector part 97' is dimensioned to fit within the hood 104 of connector part 97.

FIGS. 12 and 13 show a contact terminal 116 having an alternative form of connecting means 120 in accordance with the invention. Connecting means 120 of this terminal has a yoke 126, a shank 128, a lower or fixed jaw 124, a movable jaw 122, and a toggle 130 which extends from the jaw 122 to the yoke as previously described. The particular terminal shown in a pin type terminal having a contact portion 118 extending from the yoke.

The connecting means of the contact terminal of FIGS. 12 and 13 differs from the previously described embodiment in that a web 132 is provided which extends between the movable jaw 122 and the fixed jaw 124 at the rearward ends of these jaws. This contact terminal is applied to a conductor by applying the forces $F_1$, $F_2$ simultaneously to the free end of the movable jaw and the knee joint of the toggle. The apparatus for applying this connecting device to a conductor differs from the apparatus shown in FIGS. 8 and 9 in that it would not have a spring loaded punch but would consist simply of a means for simultaneously applying the forces $F_1$, and $F_2$. During the application of the connecting device of FIGS. 12 and 13, to a conductor the jaw is swung downwardly and the web is plastically deformed.

It will be apparent that when the terminal of FIGS. 12 and 13 is applied to a conductor, there is very little movement of the upper jaw in its own plane parallel to the lower jaw as described with reference to the previous embodiment. The teeth 124 of the upper jaw are located such that their forwardly facing edges are adjacent to the rearwardly facing edges of the teeth 136 on the lower jaw 124. Connecting means of the type shown in FIGS. 12 and 13 can be used to advantage where electrical connections to stranded or solid wires having relatively thick insulation are being made since the points of the teeth dip into and penetrate insulation to establish contact with the conducting core of the wire. Under some circumstances, the extrusion and/or fracture methods of establishing electrical contact may be impractical if the insulation is relatively thick.

It will be noted that the connecting portion of the contact terminal shown in FIGS. 12 and 13 has an elongated slot 138 in its lower jaw beneath the teeth 136. This slot divides the lower jaw into upper and lower strap sections 140, 142 and when the terminal is applied to a conductor, the upper strap section 140 is resiliently flexed in the manner of a beam fixed at each of its ends. This flexures provides additional stored energy for the maintenance of the electrical interface in that as a result of this flexure, the teeth 136 of the lower jaw are urged downwardly and against the conductor and the teeth of the upper jaw. This fixed beam spring system is, like the cantilever beam spring system of the previously described embodiment, substantially independent of the toggle system so that, as with the previous embodiment, redundancy in the spring system is provided for maintaining contact.

A wide variety of specific applications of the principles of the invention and modifications of the herein disclosed embodiments of the invention which are within the scope of the appended claims will be apparent to those skilled in the electrical art. The connecting means of the invention, that is the toggle mechanism in combination with the closeable jaws, can be used in terminals other than those shown, for example, terminals having integral posts which are adapted to be soldered to the conductors of a printed circuit board. Connecting devices for simply permanently splicing the conductors of the flat cables can be made by simply forming a splice connector having a connecting means in accordance with the invention at each end thereof. It may under some circumstances be desirable to substitute for the shank portions of the connecting means 128 of FIG. 12 and 18 or 20 of FIG. 2, a second toggle mechanism or toggle link.

Changes in construction will occur to those skilled in the art and various apparently different modifications and embodiments may be made without departing from the scope of the invention. The matter set forth in the foregoing description and accompanying drawings is offered by way of illustration only.

What is claimed is:

1. An electrical connection between an elongated conductor and a connecting device, said connecting advice comprising a relatively thin sheet metal one-piece plate-like connecting member having a yoke portion and first and second jaws, said jaws having free ends and having fixed ends, said fixed ends being spaced from and connected to, said yoke portion, said jaws and said yoke portion being co-planar, said jaws being closed onto said conductor with said conductor extending into said jaws between said free ends and towards said yoke portion, said jaws having interdigitated contact portions comprising teeth extending from said jaws, said contact portions engaging said conductor, said contact portions comprising surface portions on said teeth on said first jaw facing generally towards said free ends and surface portions on said teeth on said second jaw facing generally towards said yoke portion, said conductor having portions extending between said contact portions, said first jaw being connected to said yoke portion by a compressively stressed link means a web integral with, and extending between, said first and second jaws, said web being located between said teeth and said compressively stressed link means, one of said jaws having an elongated opening therein whereby said one jaw comprises a pair of coextensive strap sections, said teeth on said one jaw being integral with one of said strap sections, said one strap section being stressed in the manner of a beam fixed at each end thereby to provide added stored energy urging said teeth on said one strap section against said conductor and against said teeth on said other jaw whereby, said first jaw is resiliently biased outwardly from said yoke portion by said compressively stressed link means, and said contact portions of said first jaw are thereby urged against said portions of said conductor and against said contact portions of said second jaw thereby to establish electrical contact with said conductor.

2. A connection as set forth in claim 1, said teeth extending from said first jaw being relatively short, and said teeth extending from said second jaw being substantially longer than said teeth extending from said first jaw, said teeth extending from said second jaw being resiliently stressed in the manner of a cantilever beam, the stresses in said teeth of said second jaw tending to flex said teeth towards said free ends whereby, said contact portions of said teeth of said second jaw are resiliently urged towards said contact portions of said teeth of said first jaw.

* * * * *